US005332109A

United States Patent [19]

Johnson

[11] Patent Number: 5,332,109

[45] Date of Patent: Jul. 26, 1994

[54] WET CLOTHES HANGING DEVICE

[76] Inventor: Sandra C. Johnson, 1355 Brookside Dr., Venice, Fla. 34292

[21] Appl. No.: 90,514

[22] Filed: Jul. 13, 1993

[51] Int. Cl.[5] ..... A47F 5/00

[52] U.S. Cl. ..... 211/96; 211/87; 211/105.1

[58] Field of Search ..... 211/87, 96, 105.1, 204, 211/100, 123; 248/127, 176; D6/553

[56] References Cited

U.S. PATENT DOCUMENTS

| | | | |
|---|---|---|---|
| 2,175,421 | 10/1939 | Wright | 211/96 X |
| 2,598,502 | 5/1952 | Butler | 211/96 X |
| 2,626,714 | 1/1953 | Rover | 211/100 |
| 2,647,642 | 8/1953 | Kosash | 211/100 |
| 2,743,023 | 4/1956 | Larson | 211/96 |
| 3,174,628 | 3/1965 | Kirch | 211/123 |
| 3,237,778 | 3/1966 | Hoodis | 248/127 X |
| 4,819,812 | 4/1989 | Demarest | 211/123 X |
| 5,069,350 | 12/1991 | Wolff et al. | 211/87 |

*Primary Examiner*—Robert W. Gibson, Jr.
*Attorney, Agent, or Firm*—Charles J. Prescott

[57] ABSTRACT

A clothes hanging device for use in conjunction with a laundry tub for drip-drying wet clothing. The device is structured for connection onto a wall and, when properly positioned on the wall in suitable proximity to the laundry tub, serves to direct water dripped from wet clothes hung from either a hanging rod or laid atop a clothes screen into the laundry tub.

5 Claims, 1 Drawing Sheet

WET CLOTHES HANGING DEVICE

BACKGROUND OF THE INVENTION

1. Scope of Invention

This invention relates generally to clothes hanging devices, and more particularly to a clothes hanging device for drip drying wet clothes in conjunction with a conventional laundry tub.

2. Prior Art

Despite the existence of modern clothes dryers, many individuals continue to prefer to hang and drip dry certain articles of clothing after laundering. These wet articles of clothing are typically suspended over conventional clothes hangers which are, in turn, hung from a clothes line or the like either out of doors or inside a building or home, such as in a laundry room or basement.

When wet clothes are hung for drip drying inside a home, the individual has to be concerned about the consequences of the water dripped from the clothes. If that water is allowed to drip onto a floor surface, either mold or mildew damage may result over a period of time and/or the floor surface may become slippery or otherwise more rapidly dirtied from feet tracking through the water on the floor.

Most utility rooms in homes now include a conventional laundry tub. These tubs include a generally rectangular basin supported above the floor surface on legs disposed at each corner of the basin. Laundry tubs are normally used for more utilitarian type laundry and other similar types of cleaning projects. The laundry tub is generally positioned in proximity to a wall for plumbing and convenient access purposes.

The present invention is structured to take advantage of the existence and placement of these conventional laundry tubs immediately adjacent a wall surface. By positioning the invention in alignment with and slightly above the rim of the laundry tub on the wall immediately adjacent thereto, wet articles of clothing may be hung from a hanging rod provided with the device on conventional hangers so that water will drip downwardly from the wet clothing into the tub. Any drippage not directly falling over the basin of the laundry tub will be deflected into the laundry tub by an integral lower splash panel associated with the device. Side panels of the device forwardly extending also serve to help insure that water dripped from the articles of wet clothing is deflected downwardly by gravity into the laundry tub and kept from splashing or running onto the wall.

BRIEF SUMMARY OF THE INVENTION

This invention is directed to a clothes hanging device for use in conjunction with a laundry tub for drip-drying wet clothing. The device is structured for connection onto a wall and, when properly positioned on the wall in suitable proximity to the laundry tub, serves to direct water dripped from wet clothes hung from either a hanging rod or laid atop a clothes screen into the laundry tub.

It is therefore an object of this invention to provide a wet clothes hanging device for use in conjunction with a conventional laundry tub for insuring that water dripped from wet articles of clothing hung from the device will be collected into the laundry tub without splashing or dripping water onto wall or floor surfaces.

It is yet another object of this invention to provide a slatted screen surface in conjunction with the above device for supporting more delicate articles of wet clothing in the flat for drip-drying directly above the laundry tub.

It is still another object of this invention to be either retrofitted by attachment to an existing wall surface without modification or to be built into the wall surface when the wall or building is constructed.

In accordance with these and other objects which will become apparent hereinafter, the instant invention will now be described with reference to the accompanying drawings.

DETAILED DESCRIPTION OF THE INVENTION

Figure 1:
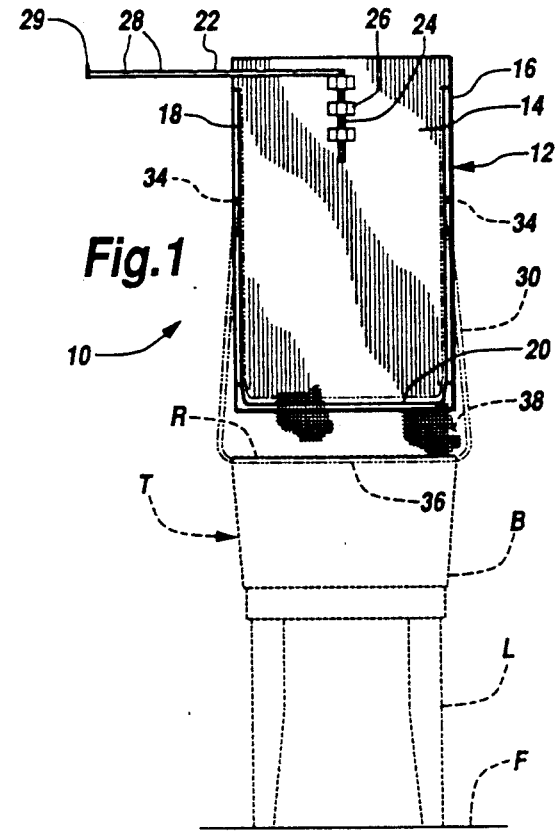
FIG. 1 is a front elevation view of the device connected onto a wall surface immediately adjacent and slightly above a conventional laundry tub shown in phantom.
Figure 2:
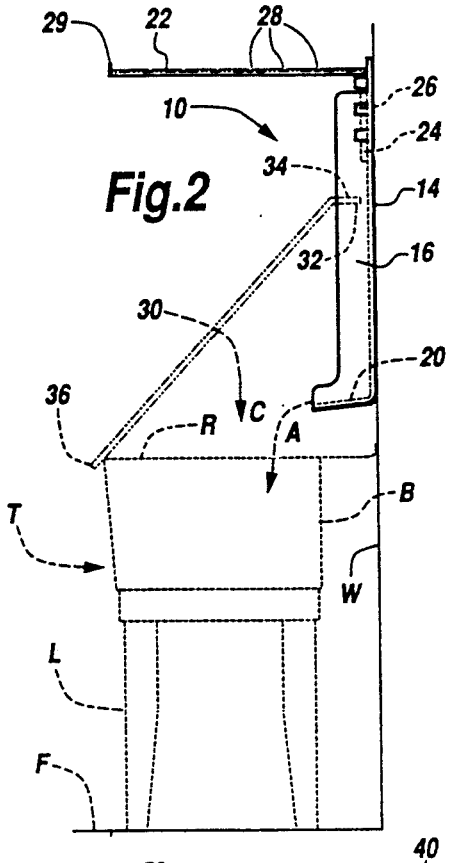
FIG. 2 is a side elevation view of FIG. I depicting an optional slanted framed screen for supporting delicate articles of wetted clothing in the flat.

Referring now to the drawings, and particularly to FIGS. 1 and 2, one embodiment of the invention is there shown generally at numeral 10. This embodiment 10 includes an upright splash panel 12 having a generally rectangular central portion 14 having a flat back surface which is connectable onto a surface of a wall W. The splash panel 12 also includes forwardly extending side panels 16 and 18 which extend vertically substantially along the entire length of the side margins of the central portion 14. A drip deflector panel 20 also forwardly extends from the lower horizontal margin of the central portion 14, extending laterally between the lower ends of each of the side panels 16 and 18.

Also included in this embodiment 10 is a hanging rod 22 formed of rigid tubular stock having a generally horizontal L-shaped configuration. This hanging rod 22 is pivotally connected by its upright leg 24 into a plurality of formed brackets 26 which are, in turn, connected centrally near the upper margin of central portion 14 as shown. By this arrangement, the horizontal leg of the hanging rod 22 is freely pivotable about an upright axis defined by leg 24.

The hanging rod 22 includes a plurality of notches or detents 28 which are structured to receive a curved hook of a conventional coat hanger (not shown) and to maintain relative positioning of the clothes hanger (not shown). An end stop 29 prevents inadvertent disengagement of the clothes hanger from the end of the hanging rod 22.

The hanging rod 22 is positioned above the drip deflector panel 20 a distance determined by the upright length of central portion 14 such that the lower margins of articles of clothing (not shown) hung on the coat hanger (not shown) from hanging rod 22 will be positioned near or slightly above the drip deflector panel 20.

To accomplish its intended purpose, the device 10 is connected to a surface of wall W in lateral alignment with and just above a rim R of a conventional laundry tub T shown in phantom. Typically, such a laundry tub T is installed in close proximity to the wall W both for convenience of plumbing hookup and use. These laundry tubs T include a rectangular deep-walled basin B supported above the floor F by legs L downwardly extending from each corner of the basin B.

By positioning the drip deflector panel 20 of the device 10 slightly above the rim R as best seen in FIG. 2, wet clothing hung from the hanging rod 22 on the conventional clothes hanger will drip water downwardly by gravity into the basin B. Additional water dripped from the wet clothing will also be splashed onto and run down the central portion 14 onto the drip deflector panel 20, then to fall into the basin B in the direction of arrow A.

Thus, by this arrangement, all water dripped from wet clothing hung from the hanging rod 22 will fall into the basin B without contacting the wall W or dripping onto the floor F.

To help insure that water dripping from the wet clothing will not migrate laterally from central portion 14, the side panels 16 and 18, integrally formed with the splash panel 12, redirect all splashed and dripping water downwardly onto the drip deflector panel 20.

Optionally, to accommodate very delicate articles of clothing such as sweaters, delicate blouses and the like, a removable wet clothes support panel 30 shown in phantom is also provided. This support panel 30 is formed of a generally U-shaped tubular frame having its free distal ends 34 interengagable into cavities 32 formed into the edge margins of each side panel 16 and 18 as shown.

Stretched within the U-shaped frame of the support panel 30 is a flexible support screen 38 which may be formed of a convenient mesh or screened material having openings integrally formed therewith of sufficient size so as to allow water to pass therethrough. The lower segment 36 of the tubular frame is positioned at a sloped angle from cavities 32 so as to be supported by the rim R as shown. By this arrangement, wet articles of clothing may be laid in the flat atop the support screen 38 over the basin B and allowed to drip dry so that water will fall in the direction of arrow C into the basin, thus avoiding undue stretching of the clothing as it drip dries. Dripped water is also deflected in the direction of arrow A by drip deflector panel 20, with side panels 16 and 18 preventing water from splashing on the wall W as previously described.

Figure 5:
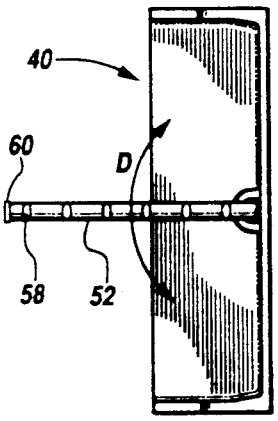
FIG. 5 is a top plan view of FIG. 3.
Figure 4:
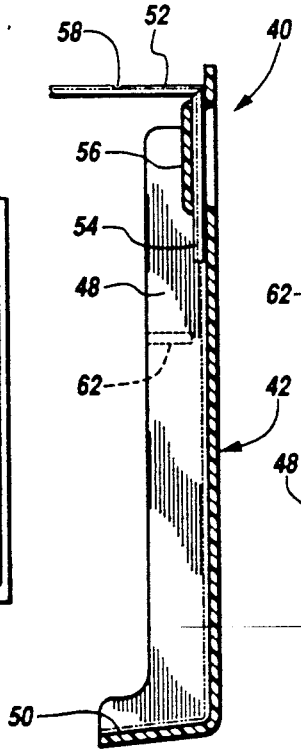
FIG. 4 is a central vertical section view through the embodiment of the device 40 shown in FIG. 3.
Figure 3:
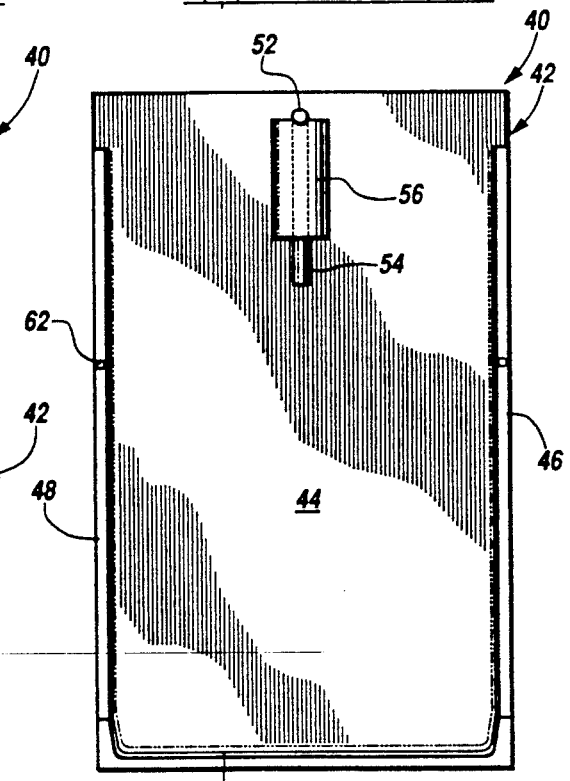
FIG. 3 is a front elevation view of another embodiment of the invention.

Referring now to FIGS. 3, 4 and 5, another embodiment of the invention is there shown generally at numeral 40. This embodiment 40 is substantially similar to the embodiment 10 shown in FIGS. I and 2, again formed of molded plastic material having a generally rectangular flat central portion 44 connected against a wall surface (not shown), molded forwardly extending side panels 46 and 48 and a lower forwardly extending drip deflector panel 50 integrally connected and laterally extending between the lower ends of the side panels 46 and 48.

The splash panel 42 includes a molded boss or raised area 56 in lieu of brackets 26 shown in the embodiment 10. This molded boss area 56 is then drilled to have an upright hole at each end thereof for receiving the upright leg 54 of the hanging rod 52. By this arrangement, the hanging rod 52 is freely pivotable about the upright axis defined by upright leg 54 within the molded boss 56 back and forth in the direction of arrow D.

As previously described, hanging rod 52 includes notches 58 in its upper surface for positioning conventional coat hangers thereon and also includes a stop 60 to prevent inadvertent disengagement of the clothes hangers from the end thereof.

In both embodiments 10 and 40, the drip deflector panels 20 and 50 are preferably sloped downwardly as shown to enhance water drainage and to prevent water pooling at that point.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A wet clothes hanging device for drip-drying wet clothes and for directing water drippage from the wet clothes into a laundry tub comprising:

an upright splash panel connectable to a wall adjacent the laundry tub;

said splash panel including forwardly extending side panels and a lower forwardly extending drip deflector panel;

a hanging rod connected to and horizontally extending in a forwardly direction from an upper point of said splash panel, said hanging rod structured to supportively receive wet clothing, as on a clothes hanger, hung therefrom;

said drip deflector panel being positioned immediately adjacent and just above a rim of the laundry tub directing water dripped from the wet clothing into the laundry tub;

said side panels preventing the water dripped from the wet clothing from splashing or running onto the wall.

2. A wet clothes hanging device as set forth in claim 1, wherein: said hanging rod is pivotally connected about an upright axis to said splash panel.

3. A wet clothes hanging device as set forth in claim 2, further comprising:

a wet clothes support panel including a generally U-shaped frame and a support screen tightly stretched and connected across said frame;

said frame supportably connectable at one end to each said side panel and supported at the other end thereof by the rim whereby said support screen is supported by said frame over the laundry tub;

said support screen structured for receiving an article of wet clothing laid thereon in the flat and for allowing water dripping from the article of wet clothing to pass downwardly through said support screen into the laundry tub.

4. A wet clothes hanging device connectable to a wall comprising:

a rigid molded splash panel having a generally flat rectangular central portion and generally orthogonal side panels along and forwardly extending from each upright edge of said central portion;

said splash panel also having a drip deflector panel extending forwardly from a lower edge of said central portion and extending horizontally between a lower end of each said side panel;

a generally L-shaped hanging rod having an upright leg pivotally connected to an upper panel of said central portion and a generally horizontal leg extending from said pivotal connection;

said hanging rod and said drip deflector panel being cooperatively structured, when said splash panel is connected onto the wall directly adjacent to a laundry tub and the laundry tub is also positioned adjacent the wall directly beneath said splash panel, to direct water dripped from a wet article of clothing hung from said horizontal leg into the laundry tub.

5. A wet clothes hanging device as set forth in claim 4, further comprising:

a wet clothes support panel including a generally U-shaped frame and a support screen tightly stretched and connected across said frame;

said frame supportably connectable at one end to each said side panel and supported at the other end thereof by the rim whereby said support screen is supported by said frame over the laundry tub;

said support screen structured for receiving an article of wet clothing laid thereon in the flat and for allowing water dripped from the flat article of clothing to pass downwardly through said support screen into the laundry tub.

* * * * *